US010151554B2

(12) United States Patent
Ma

(10) Patent No.: US 10,151,554 B2
(45) Date of Patent: Dec. 11, 2018

(54) TRIGGER MECHANISM FOR TOY BLOWGUN

(71) Applicant: Buzz Bee Toys (H.K.) Co., Limited, Hong Kong (CN)

(72) Inventor: Chor-Ming Ma, Hong Kong (CN)

( * ) Notice: Subject to any disclaimer, the term of this patent is extended or adjusted under 35 U.S.C. 154(b) by 0 days.

(21) Appl. No.: 14/632,260

(22) Filed: Feb. 26, 2015

(65) Prior Publication Data

US 2016/0146568 A1 May 26, 2016

(30) Foreign Application Priority Data

Nov. 24, 2014 (HK) ..... 14111871.5

(51) Int. Cl.

| | |
|---|---|
| ***F41B 1/00*** | (2006.01) |
| ***F41B 11/723*** | (2013.01) |
| ***F41B 11/89*** | (2013.01) |
| ***F41B 11/682*** | (2013.01) |
| ***F41B 11/68*** | (2013.01) |

(52) U.S. Cl.

CPC ..... *F41B 11/723* (2013.01); *F41B 1/00* (2013.01); *F41B 11/68* (2013.01); *F41B 11/682* (2013.01); *F41B 11/89* (2013.01)

(58) Field of Classification Search

CPC ..... F41B 11/723; F41B 11/89; F41B 1/00

USPC ..... 124/62

See application file for complete search history.

(56) References Cited

U.S. PATENT DOCUMENTS

| | | | | | |
|---|---|---|---|---|---|
| 1,609,013 | A * | 11/1926 | De Cavin | F41B 1/00 | 124/62 |
| 1,838,999 | A * | 12/1931 | Mihalyi | F41A 9/72 | 124/52 |
| 2,679,838 | A * | 6/1954 | Thompson | F41B 1/00 | 124/62 |
| 4,419,978 | A * | 12/1983 | Loftus | F42B 6/00 | 124/41.1 |
| 6,698,672 | B1 * | 3/2004 | Linkletter | B05B 1/005 | 239/280 |
| 2005/0020999 | A1 * | 1/2005 | Hodgson | A61D 7/04 | 604/512 |
| 2006/0137673 | A1 * | 6/2006 | Huang | F41B 1/00 | 124/79 |
| 2008/0216806 | A1 * | 9/2008 | Tseng | F41B 11/55 | 124/62 |
| 2009/0007895 | A1 * | 1/2009 | Kenworthy | F41B 1/00 | 124/62 |
| 2013/0167820 | A1 * | 7/2013 | Gilbertson | F41B 1/00 | 124/62 |
| 2013/0213376 | A1 * | 8/2013 | Kenworthy | F42B 6/003 | 124/62 |
| 2013/0247887 | A1 * | 9/2013 | Flint | F42B 10/06 | 124/16 |

(Continued)

*Primary Examiner* — Michael David

(57) ABSTRACT

A trigger mechanism for a toy blowgun wherein the toy blowgun comprises: a launching mechanism for launching a projectile from the toy blowgun; and a locking mechanism for locking the launching mechanism in a primed configuration, the locking mechanism being releasable to launch the projectile from the toy blowgun. The trigger mechanism comprises: a trigger chamber having an inlet for receiving a flow of air; and a shuttle movable from a start position to a launching position in the trigger chamber by the flow of air to release the locking mechanism.

15 Claims, 4 Drawing Sheets

(56) References Cited

U.S. PATENT DOCUMENTS

| | | | | |
|---|---|---|---|---|
| 2013/0319389 | A1* | 12/2013 | Cho | F41B 11/70 124/73 |
| 2014/0155200 | A1* | 6/2014 | Flint | F42B 12/56 473/577 |
| 2014/0283809 | A1* | 9/2014 | Huebl | F41B 11/54 124/65 |
| 2014/0360070 | A1* | 12/2014 | Hendricks | F41B 11/60 42/1.08 |
| 2015/0168115 | A1* | 6/2015 | Higham | B63C 9/26 89/1.34 |
| 2015/0282914 | A1* | 10/2015 | Gray | A61D 7/00 604/130 |

* cited by examiner 7
1
6
11
11
13
2
3
12
4

7
6
36
5

7
-9-
1
8
22
6
21, 24
11
11
20, 23
-10-
-19-
16
-18-
5
17
2
13
3
14
15
12
4

7
-9-
1
6
5
28
2
30
27
3
13
12
4
37
8
32
11
-10-
33
35
31
-26-
25
34
29
14

TRIGGER MECHANISM FOR TOY BLOWGUN

FIELD OF THE INVENTION

The present invention relates to trigger mechanisms for toy blowguns.

BACKGROUND OF THE INVENTION

Toy blowguns typically fire projectiles such as darts. They are relatively simple devices, but have always been popular as toys or for use in recreational activities. A user simply inserts a projectile inside a pipe portion of a blowgun and then blows a powerful, short blast of air into a mouthpiece at one end of the pipe portion. The force of the blast of air provides propulsive power to the projectile, launching it from the pipe into the air towards an intended target.

The propulsive power depends on the respiratory power produced by the user. As such, the use of blowguns provides exercise benefits, especially in developing the lungs.

Children, however, typically do not have sufficient respiratory power to use blowguns, and even toy blowguns, effectively. This is especially so for younger children. In particular, it is difficult for children to fire projectiles from prior blowguns at speeds or at distances that make the use of these blowguns particularly fun or interesting.

It is an object of the present invention to overcome or ameliorate at least one of the disadvantages of the prior art, or to provide a useful alternative.

SUMMARY OF THE INVENTION

The present invention, in a first aspect, provides a trigger mechanism for a toy blowgun wherein the toy blowgun comprises:

a launching mechanism for launching a projectile from the toy blowgun; and a locking mechanism for locking the launching mechanism in a primed configuration, the locking mechanism being releasable to launch the projectile from the toy blowgun;

and wherein the trigger mechanism comprises:

a trigger chamber having an inlet for receiving a flow of air; and a shuttle movable from a start position to a launching position in the trigger chamber by the flow of air to release the locking mechanism.

In one embodiment, the trigger chamber has one or more vents adjacent the launching position to facilitate the escape of air from the trigger chamber as the shuttle moves from the start position to the launching position.

In one embodiment, the trigger chamber is a tube, the shuttle movable in a longitudinal direction along the tube, the tube having a transverse tube cross-section, and the shuttle having a transverse shuttle cross-section closely fitting within the transverse tube cross-section.

In a second aspect, the present invention provides a toy blowgun comprising:

a launching mechanism for launching a projectile from the toy blowgun;

a locking mechanism for locking the launching mechanism in a primed configuration, the locking mechanism being releasable to launch the projectile from the toy blowgun;

a trigger mechanism as described above.

In one embodiment, the toy blowgun comprises a projectile chamber for holding a projectile to be launched, wherein the launching mechanism comprises a pressurized air chamber having an exhaust port for exhausting pressurized air from the pressurized air chamber into the projectile chamber to allow the pressurized air to launch the projectile, and wherein the locking mechanism comprises an exhaust valve closeable to seal the exhaust port in the primed configuration, the trigger mechanism releasing the locking mechanism by opening the exhaust valve to unseal the exhaust port thereby allowing the exhaust port to exhaust pressurized air from the pressurized air chamber into the projectile chamber to allow the pressurized air to launch the projectile.

In one embodiment, the exhaust valve is connected to a piston inside the pressurized air chamber, the piston having a first side and a second side, the pressurized air chamber having a trigger port for exhausting pressurized air from the pressurized air chamber adjacent the second side, the locking mechanism comprising a trigger valve closeable to seal the trigger port in the primed configuration, the shuttle opening the trigger valve in the launching position to unseal the trigger port thereby allowing the trigger port to exhaust pressurized air from the pressurized air chamber adjacent the second side resulting in a higher pressure on the first side which moves the piston into the second side thereby opening the exhaust valve.

In one embodiment, the pressurized air chamber is sleeved into the trigger chamber such that sliding the pressurized air chamber into the trigger chamber forces air into the pressurized air chamber, thereby pressurizing air inside the pressurized air chamber.

In one embodiment, the pressurized air chamber comprises a priming port for receiving air from the trigger chamber into the pressurized air chamber, and a priming valve closeable to seal the priming port in the primed configuration and openable as air is forced against the priming valve when the pressurized air chamber is slid into the trigger chamber.

In one embodiment, the trigger port is also the priming port and the trigger valve is also the priming valve, the trigger valve openable as air is forced against the trigger valve when the pressurized air chamber is slid into the trigger chamber.

In one embodiment, the shuttle seals the inlet when in the start position.

In one embodiment, the exhaust valve is closed by the pressurized air.

In another embodiment, the toy blowgun comprises a projectile chamber for holding a projectile to be launched, wherein the launching mechanism comprises a pressurized air chamber having an exhaust port for exhausting air from the pressurized air chamber into the projectile chamber to allow the air to launch the projectile, an air ram movable from a first end of the pressurized air chamber opposite the exhaust port towards the exhaust port to force air through the exhaust port from the pressurized air chamber into the projectile chamber to allow the air to launch the projectile, a resilient biasing means biasing the air ram towards the exhaust port, and wherein the locking mechanism holds the air ram against the resilient biasing means at the first end of the pressurized air chamber in the primed configuration.

In one embodiment, the locking mechanism comprises a catch to hold the air ram against the resilient biasing means at the first end, the shuttle releasing the catch in the launching position.

In one embodiment, the launching mechanism comprises a manual actuator sleeved over the pressurized air chamber and connectable to the air ram such that applying a sliding force to slide the manual actuator away from the exhaust port moves the air ram away from the exhaust port against the resilient biasing means to the first end to be held by the locking mechanism in the primed configuration.

In one embodiment, the launching mechanism comprises a second resilient biasing means to move the manual actuator back towards the exhaust port once the sliding force is removed.

Further features of various embodiments of the present invention are defined in the appended claims. It will be appreciated that the features above may be combined in various combinations in various embodiments of the present invention.

Throughout this specification, including the claims, the words "comprise", "comprising", and other like terms are to be construed in an inclusive sense, that is, in the sense of "including, but not limited to", and not in an exclusive or exhaustive sense, unless explicitly stated otherwise or the context clearly requires otherwise.

BRIEF DESCRIPTION OF THE FIGURES

Preferred embodiments in accordance with the best mode of the present invention will now be described, by way of example only, with reference to the accompanying figures, in which.

DETAILED DESCRIPTION OF THE BEST MODE OF THE INVENTION

Figures 1, 2A, 2B, 2C, 2D:
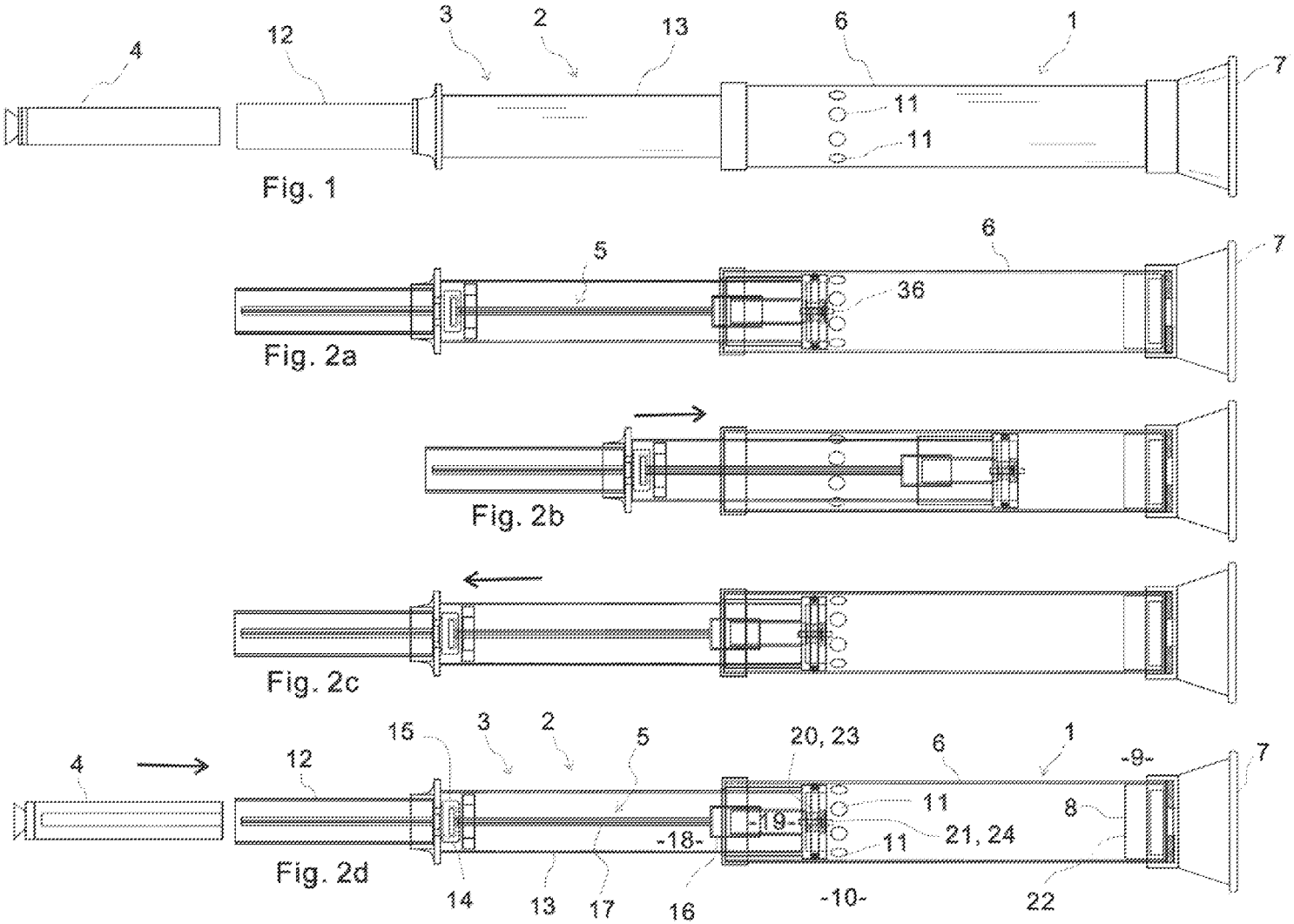
FIG. 1 is a schematic diagram of a toy blowgun with a trigger mechanism in accordance with an embodiment of the present invention.
FIGS. 2*a* to 2*h* are cutaway schematic diagrams of the toy blowgun of FIG. 1 showing the sequence of priming the toy blowgun by pumping and pressurizing air in a pressure chamber of the toy blowgun, loading a projectile, and operating the trigger mechanism to release the pressurized air in the pressure chamber to fire the projectile.

Referring to the figures, there is provided a trigger mechanism 1 for a toy blowgun 2. The toy blowgun comprises a launching mechanism 3 for launching a projectile 4 from the toy blowgun. There is also a locking mechanism 5 for locking the launching mechanism 3 in a primed configuration. The locking mechanism 5 is releasable to launch the projectile 4 from the toy blowgun 2. The trigger mechanism 1 comprises a trigger chamber 6 having an inlet 7 for receiving a flow of air. A shuttle 8 is movable from a start position 9 to a launching position 10 in the trigger chamber 6 by the flow of air to release the locking mechanism 5.

The trigger chamber 6 has one or more vents 11 adjacent the launching position 10 to facilitate the escape of air from the trigger chamber as the shuttle 8 moves from the start position 9 to the launching position 10. Preferably, the trigger chamber 6 is a tube, and the shuttle 8 is movable in a longitudinal direction along the tube. The tube 6 has a transverse tube cross-section, and the shuttle 8 has a transverse shuttle cross-section closely fitting within the transverse tube cross-section. One advantage of the shuttle being closely fitting is that the shuttle will move more smoothly along the tube.

Embodiments of the present invention are directed to the trigger mechanism 1 separately, as well as to a toy blowgun 2 that incorporates or is assembled with the trigger mechanism 1. The trigger mechanism 1 can be used with different types of toy blowguns 2.

Figure 2E:
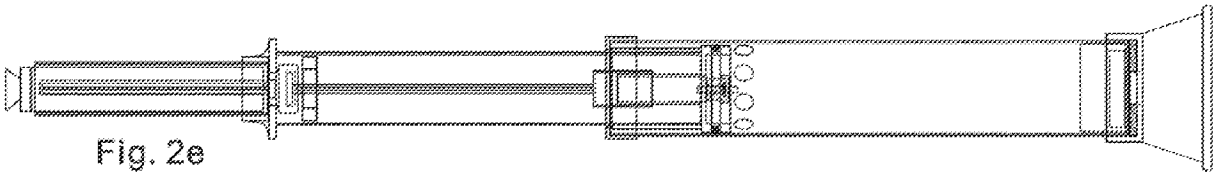
Figure 2F:
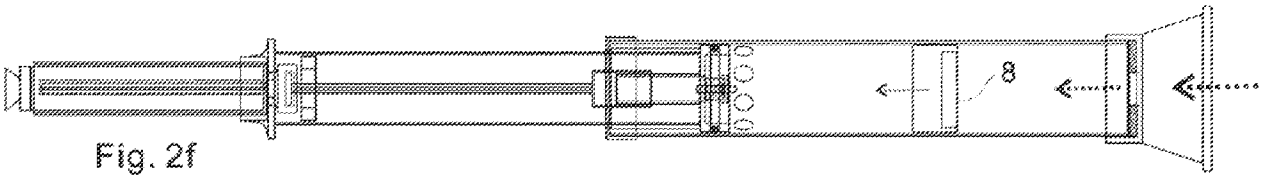
Figure 2G:
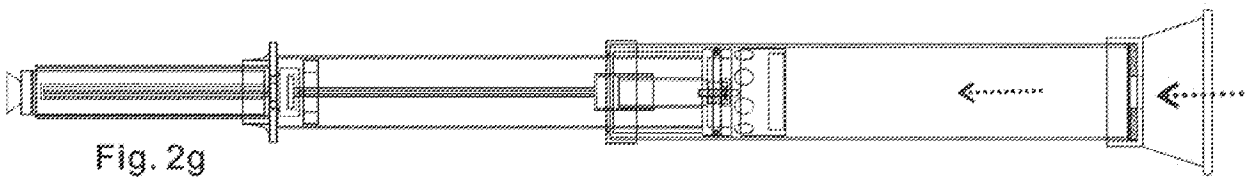
Figure 2H:
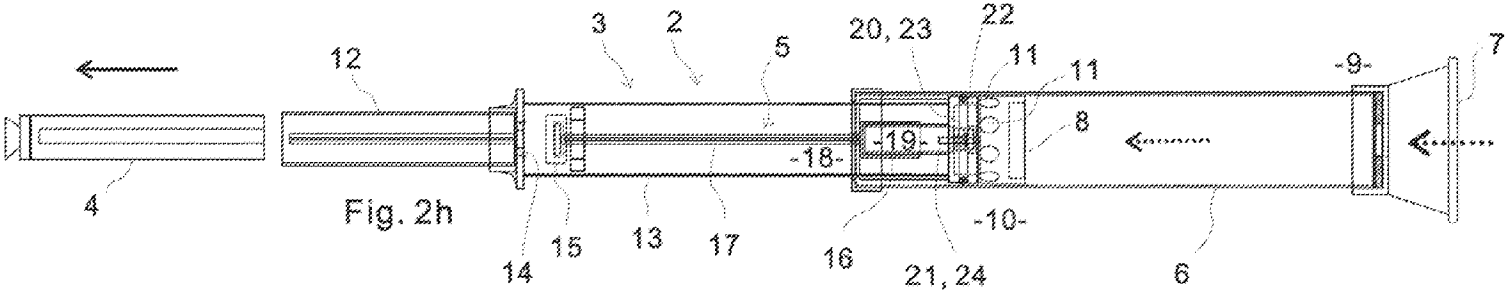

One type of toy blowgun 2 is shown in FIGS. 1 and 2*a* to 2*h*. This toy blowgun 2 comprises a projectile chamber 12 for holding the projectile 4 to be launched. The launching mechanism 3 comprises a pressurized air chamber 13 having an exhaust port 14 for exhausting pressurized air from the pressurized air chamber 13 into the projectile chamber 12 to allow the pressurized air to launch the projectile 4. The locking mechanism 5 comprises an exhaust valve 15 closeable to seal the exhaust port 14 in the primed configuration. The trigger mechanism 1 releases the locking mechanism 5 by opening the exhaust valve 15 to unseal the exhaust port 14 thereby allowing the exhaust port to exhaust pressurized air from the pressurized air chamber 13 into the projectile chamber 12 to allow the pressurized air to launch the projectile 4.

The exhaust valve 15 is connected to a piston 16 inside the pressurized air chamber 13. In particular, the exhaust valve 15 is in the form of a flat disc that covers the exhaust port 14 in order to seal the exhaust port. The flat disc is connected to the piston 16 with a rod 17. The piston has a first side 18 and a second side 19. The pressurized air chamber 13 also has a trigger port 20 for exhausting pressurized air from the pressurized air chamber 13 adjacent the second side 19.

The locking mechanism 5 comprises a trigger valve 21 closeable to seal the trigger port 20 in the primed configuration. The shuttle 8 opens the trigger valve 21 in the launching position 10 to unseal the trigger port 20 thereby allowing the trigger port to exhaust pressurized air from the pressurized air chamber 13 adjacent the second side 19. This results in a higher pressure on the first side 18 which moves the piston into the second side 19 thereby opening the exhaust valve 15. The shuttle 8 has an actuating face 22 that impacts a stem 36 of the trigger valve 21 when the shuttle arrives at the launching position 10 at one end of the trigger chamber 6. This causes the trigger valve 21 to unseat and unseal the trigger port 20.

The pressurized air chamber 13 is sleeved into the trigger chamber 6 such that sliding the pressurized air chamber 13 into the trigger chamber 6 forces air into the pressurized air chamber 13, thereby pressurizing air inside the pressurized air chamber. The pressurized air chamber 13 comprises a priming port 23 for receiving air from the trigger chamber 6 into the pressurized air chamber. A priming valve 24 is closeable to seal the priming port 23 in the primed configuration and openable as air is forced against the priming valve 24 when the pressurized air chamber 13 is slid into the trigger chamber 6. In the embodiment shown, the trigger port 20 is also the priming port 23 and the trigger valve 21 is also the priming valve 24, with the trigger valve openable as air is forced against the trigger valve when the pressurized air chamber 13 is slid into the trigger chamber 6. In other embodiments, the priming port 23 and the priming valve 24 are separate features to the trigger port 20 and the trigger valve 21.

The shuttle 8 seals the inlet 7 when in the start position 9. This allows air to be forced into the pressurized air chamber 13, through the priming port 23, when the pressurized air chamber 13 is slid into the trigger chamber 6. The shuttle 8 can seal the inlet by way of a flat face on the shuttle that covers the inlet 7 when the shuttle lies against the inlet in the start position 9. Alternatively, or in combination, the shuttle 8 can seal the inlet by way of the transverse shuttle cross-section being closely fitting within the transverse tube cross-section as described above. In this case, there can also be a sealing member between the shuttle 8 and the inner wall of the tube. However, the arrangement should still allow the shuttle 8 to move freely from the start position 9 to the launching position when a user blows into the inlet 7. In use, the toy blowgun 2 is normally held upright so that the shuttle 8 falls by the force of gravity to the start position 9 and seals the inlet 7.

When the pressurized air chamber 13 is slid into the trigger chamber 6, the outer wall of the pressurized air chamber passes and covers the vents 11. This prevents air in the trigger chamber 6 from escaping through the vents 11 which further facilitates the forcing of air in the trigger chamber 6 into the pressurized air chamber 13. The pressurized air chamber 13 can be repeatedly reciprocated or pumped into and out of the trigger chamber 6, that is, the pressurized air chamber 13 is slid into the trigger chamber 6 multiple times, in order to pressurize the air inside the pressurized air chamber 13 sufficiently.

The exhaust valve 15 is closed by the pressurized air. The pressurized air keeps the exhaust valve closed until the trigger mechanism 1 is activated.

Figure 3:
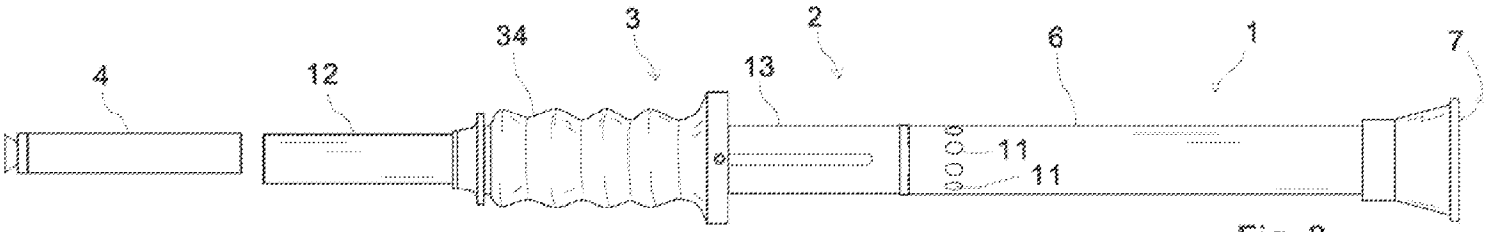
FIG. 3 is a schematic diagram of a toy blowgun with a trigger mechanism in accordance with another embodiment of the present invention.
Figure 4A:
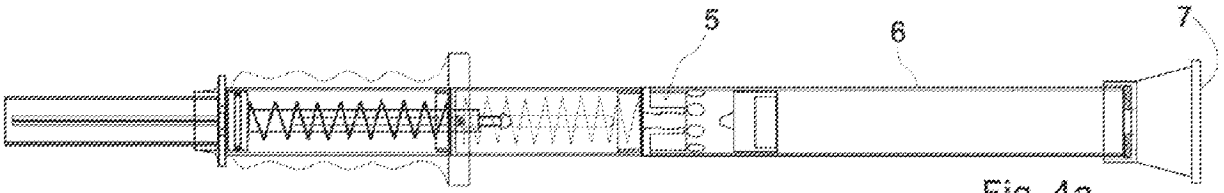
FIGS. 4*a* to 4*h* are cutaway schematic diagrams of the toy blowgun of FIG. 3 showing the sequence of priming the toy blowgun by setting a spring firing mechanism, loading a projectile, and operating the trigger mechanism to release the spring firing mechanism to fire the projectile.
Figure 4B:
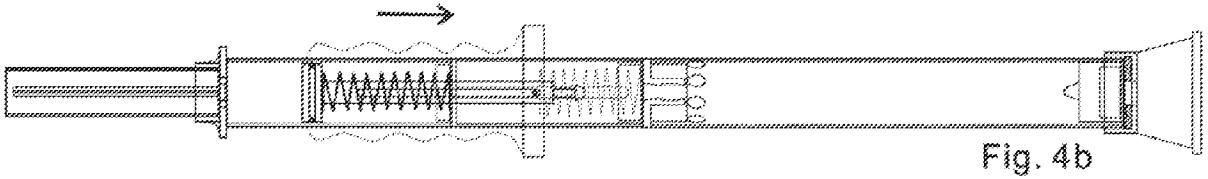
Figure 4C:
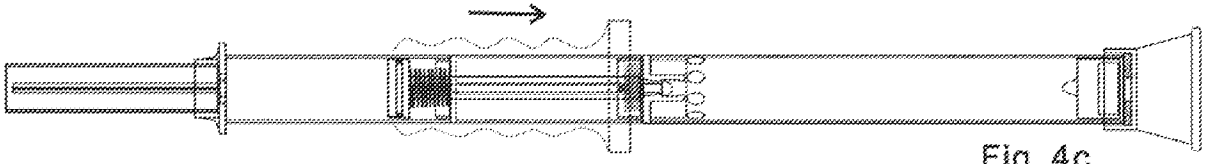
Figures 4D, 4E, 4F, 4G, 4H:
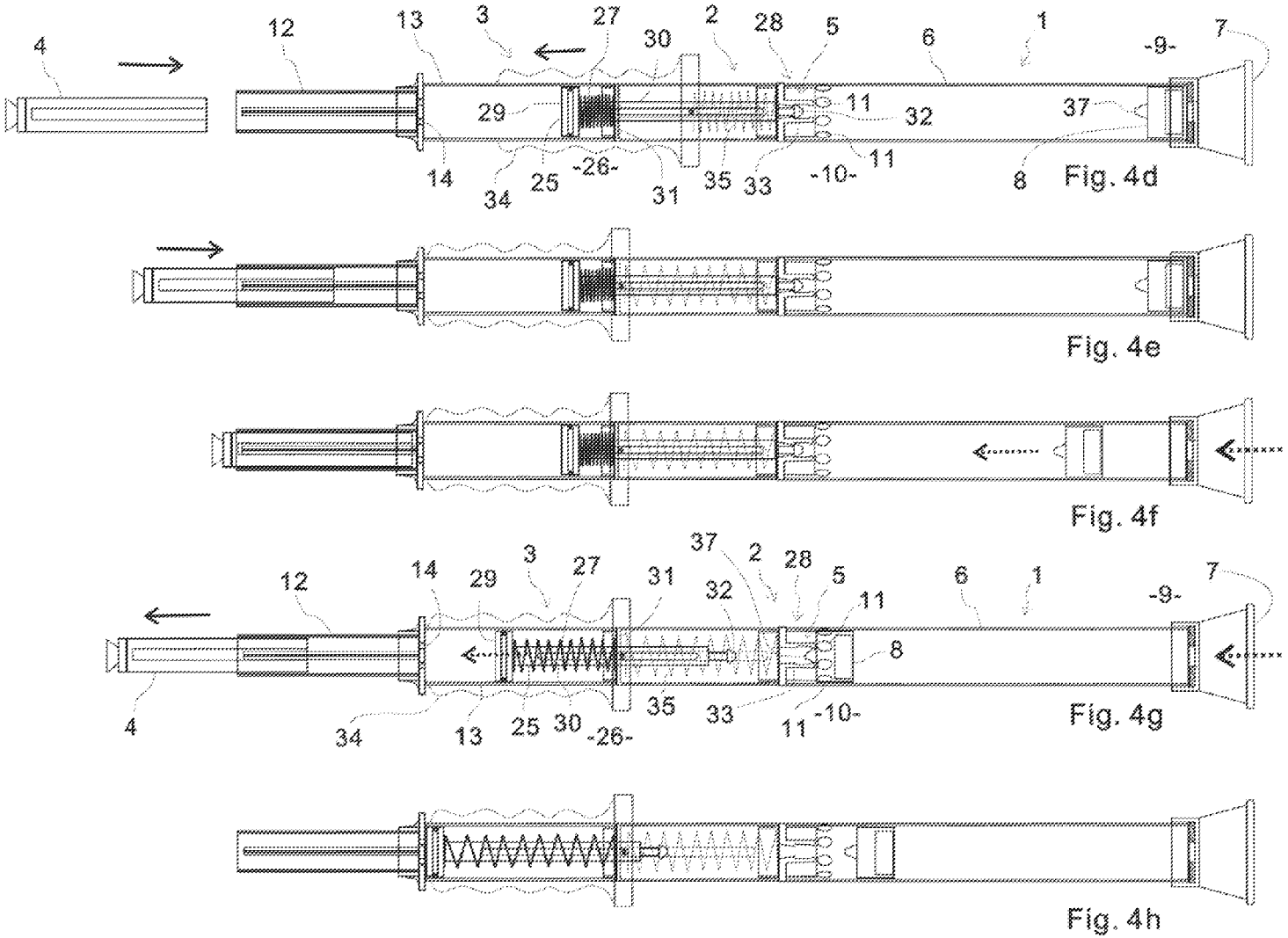

Another type of toy blowgun 2 is shown in FIGS. 3 and 4*a* to 4*h*. Similar to the toy blowgun described above, this toy blowgun 2 comprises a projectile chamber 12 for holding a projectile 4 to be launched. The launching mechanism 3 also comprises a pressurized air chamber 13 having an exhaust port 14 for exhausting air from the pressurized air chamber 13 into the projectile chamber 12 to allow the air to launch the projectile 4. In this case, however, an air ram 25 is movable from a first end 26 of the pressurized air chamber 13 opposite the exhaust port 14 towards the exhaust port to force air through the exhaust port from the pressurized air chamber 13 into the projectile chamber 12 to allow the air to launch the projectile. A resilient biasing means 27 biases the air ram 25 towards the exhaust port 14.

The locking mechanism 5 holds the air ram 25 against the resilient biasing means 27 at the first end 26 of the pressurized air chamber 13 in the primed configuration. The resilient biasing means 27 can be for example a spring, such as a coil spring. The locking mechanism 5 comprises a catch 28 to hold the air ram 25 against the resilient biasing means at the first end, the shuttle 8 releasing the catch in the launching position.

In the present embodiment, the air ram 25 comprises a ram disc 29 connected to a shaft 30. The coil spring 27 is sleeved over the shaft 30 and bears against the ram disc 29 at one end and an abutment means 31 fixedly connected to the inner wall of the pressurized air chamber 13 at the other end. The catch 28 is in the form of a domed formation 32 formed at an end of the shaft 30 opposite to the ram disc 29. The other portion of the catch 28 is a resilient keeper 33 that deforms when the domed formation 32 is forced against the resilient keeper 33 such that the domed formation 32 snap-lockingly engages with the resilient keeper 33.

The shuttle 8 has a projecting portion 37 that impacts the resilient keeper 33 when the shuttle arrives at the launching position 10 at one end of the trigger chamber 6. When the projecting portion 37 impacts the resilient keeper 33, the resilient keeper 33 deforms resulting in the domed formation 32 disengaging from the resilient keeper 33, thereby releasing the catch 28 and allowing the resilient biasing means 27 to bias and move the air ram 25 towards the exhaust port 14.

It is appreciated that other arrangements are possible in other embodiments of the present invention. For example, the projecting portion 37 can be designed to impact the domed formation 32, causing the domed formation to disengage from the resilient keeper 33.

The launching mechanism 3 comprises a manual actuator 34 sleeved over the pressurized air chamber 13 and connectable to the air ram 25 such that applying a sliding force to slide the manual actuator away from the exhaust port 14 moves the air ram away from the exhaust port against the resilient biasing means 27 to the first end 26 to be held by the locking mechanism 5 in the primed configuration. That is, the sliding force moves the domed formation 32 into snap-locking engagement with the resilient keeper 33. The launching mechanism 3 further comprises a second resilient biasing means 35 to move the manual actuator 34 back towards the exhaust port 14 once the sliding force is removed. This readies the manual actuator 34 for the next time the launching mechanism 3 is locked into the primed configuration.

It can be appreciated that the toy blowguns 2 in accordance with embodiments of the present invention allow the storage of sufficient energy to launch projectiles. Blowing a flow of air into the inlet 7 moves the shuttle 8 of the trigger mechanism 1 from the start position 9 to the launching position 10 to release the locking mechanism, thereby releasing the stored energy. It can be appreciated, however, that a much less powerful blow is required to launch a projectile from the toy blowgun 2 using the trigger mechanism in accordance with embodiments of the present invention than with prior toy blowguns where the air blown by a user directly propels the projectile. This is particularly advantageous where the user is a child or other person with low respiratory power.

It can be appreciated that the aforesaid embodiments are only exemplary embodiments adopted to describe the principles of the present invention, and the present invention is not merely limited thereto. Various variants and modifications may be made by those of ordinary skill in the art without departing from the spirit and essence of the present invention, and these variants and modifications are also covered within the scope of the present invention. Accordingly, although the invention has been described with reference to specific examples, it can be appreciated by those skilled in the art that the invention can be embodied in many other forms. It can also be appreciated by those skilled in the art that the features of the various examples described can be combined in other combinations.

What is claimed is:

1. A trigger mechanism for a toy blowgun wherein the toy blowgun comprises:

a launching mechanism for launching a projectile from the toy blowgun; and a locking mechanism for locking the launching mechanism in a primed configuration, the locking mechanism being releasable to launch the projectile from the toy blowgun;

and wherein the trigger mechanism comprises:

a trigger chamber having an inlet configured as a mouthpiece to receive a flow of air blown by a user; and a shuttle movable from a start position to a launching position in the trigger chamber by the received flow of air blown by the user, wherein the shuttle engages the locking mechanism when the shuttle arrives at the launching position in order to release the locking mechanism.

2. A trigger mechanism according to claim 1 wherein the trigger chamber has one or more vents adjacent the launching position to facilitate the escape of air from the trigger chamber as the shuttle moves from the start position to the launching position.

3. A trigger mechanism according to claim 1 wherein the trigger chamber is a tube, the shuttle movable in a longitudinal direction along the tube, the tube having a transverse tube cross-section, and the shuttle having a transverse shuttle cross-section closely fitting within the transverse tube cross-section.

4. A toy blowgun comprising:

a launching mechanism for launching a projectile from the toy blowgun;

a locking mechanism for locking the launching mechanism in a primed configuration, the locking mechanism being releasable to launch the projectile from the toy blowgun;

a trigger mechanism comprising:

a trigger chamber having an inlet configured as a mouthpiece to receive a flow of air blown by a user; and a shuttle movable from a start position to a launching position in the trigger chamber by the received flow of air blown by the user, wherein the shuttle engages the locking mechanism when the shuttle arrives at the launching position in order to release the locking mechanism.

5. A toy blowgun according to claim 4 comprising a projectile chamber for holding the projectile to be launched, wherein the launching mechanism comprises a pressurized air chamber having an exhaust port for exhausting pressurized air from the pressurized air chamber into the projectile chamber to allow the pressurized air to launch the projectile, and wherein the locking mechanism comprises an exhaust valve closeable to seal the exhaust port in the primed configuration, the trigger mechanism releasing the locking mechanism by opening the exhaust valve to unseal the exhaust port thereby allowing the exhaust port to exhaust pressurized air from the pressurized air chamber into the projectile chamber to allow the pressurized air to launch the projectile.

6. A toy blowgun according to claim 4 wherein the exhaust valve is connected to a piston inside the pressurized air chamber, the piston having a first side and a second side, the pressurized air chamber having a trigger port for exhausting pressurized air from the pressurized air chamber adjacent the second side, the locking mechanism comprising a trigger valve closeable to seal the trigger port in the primed configuration, the shuttle opening the trigger valve in the launching position to unseal the trigger port thereby allowing the trigger port to exhaust pressurized air from the pressurized air chamber adjacent the second side resulting in a higher pressure on the first side which moves the piston into the second side thereby opening the exhaust valve.

7. A toy blowgun according to claim 5 wherein the pressurized air chamber is sleeved into the trigger chamber such that sliding the pressurized air chamber into the trigger chamber forces air into the pressurized air chamber, thereby pressurizing air inside the pressurized air chamber.

8. A toy blowgun according to claim 7 wherein the pressurized air chamber comprises a priming port for receiving air from the trigger chamber into the pressurized air chamber, and a priming valve closeable to seal the priming port in the primed configuration and openable as air is forced against the priming valve when the pressurized air chamber is slid into the trigger chamber.

9. A toy blowgun according to claim 8 wherein the trigger port is also the priming port and the trigger valve is also the priming valve, the trigger valve openable as air is forced against the trigger valve when the pressurized air chamber is slid into the trigger chamber.

10. A toy blowgun according to claim 7 wherein the shuttle seals the inlet when in the start position.

11. A toy blowgun according to claim 5 wherein the exhaust valve is closed by the pressurized air.

12. A toy blowgun according to claim 4 comprising a projectile chamber for holding the projectile to be launched, wherein the launching mechanism comprises a pressurized air chamber having an exhaust port for exhausting air from the pressurized air chamber into the projectile chamber to allow the air to launch the projectile, an air ram movable from a first end of the pressurized air chamber opposite the exhaust port towards the exhaust port to force air through the exhaust port from the pressurized air chamber into the projectile chamber to allow the air to launch the projectile, a resilient biasing means biasing the air ram towards the exhaust port, and wherein the locking mechanism holds the air ram against the resilient biasing means at the first end of the pressurized air chamber in the primed configuration.

13. A toy blowgun according to claim 12 wherein the locking mechanism comprises a catch to hold the air ram against the resilient biasing means at the first end, the shuttle releasing the catch in the launching position.

14. A toy blowgun according to claim 12 wherein the launching mechanism comprises a manual actuator sleeved over the pressurized air chamber and connectable to the air ram such that applying a sliding force to slide the manual actuator away from the exhaust port moves the air ram away from the exhaust port against the resilient biasing means to the first end to be held by the locking mechanism in the primed configuration.

15. A toy blowgun according to claim 14 wherein the launching mechanism comprises a second resilient biasing means to move the manual actuator back towards the exhaust port once the sliding force is removed.

* * * * *